US009525251B2

(12) United States Patent
Yen et al.

(10) Patent No.: US 9,525,251 B2
(45) Date of Patent: Dec. 20, 2016

(54) ELECTRICAL CONNECTOR

(71) Applicant: Chant Sincere Co., Ltd., New Taipei (TW)

(72) Inventors: Ming Hui Yen, New Taipei (TW); Chun-Hsiang Hsu, New Taipei (TW)

(73) Assignee: CHANT SINCERE CO., LTD., New Taipei (TW)

( * ) Notice: Subject to any disclaimer, the term of this patent is extended or adjusted under 35 U.S.C. 154(b) by 0 days.

(21) Appl. No.: 14/967,426

(22) Filed: Dec. 14, 2015

(65) Prior Publication Data

US 2016/0233629 A1 Aug. 11, 2016

(30) Foreign Application Priority Data

Feb. 11, 2015 (TW) ..... 104202176 U

(51) Int. Cl.

| | |
|---|---|
| ***H01R 13/648*** | (2006.01) |
| ***H01R 24/60*** | (2011.01) |
| ***H01R 13/6594*** | (2011.01) |
| *H01R 107/00* | (2006.01) |
| *H01R 12/57* | (2011.01) |
| *H01R 12/72* | (2011.01) |
| *H01R 13/6586* | (2011.01) |

(52) U.S. Cl.

CPC ..... *H01R 24/60* (2013.01); *H01R 13/6594* (2013.01); *H01R 12/57* (2013.01); *H01R 12/724* (2013.01); *H01R 13/6586* (2013.01); *H01R 2107/00* (2013.01)

(58) Field of Classification Search

CPC ..... H01R 24/60; H01R 13/6586; H01R 13/65802; H01R 13/6594; H01R 12/57; H01R 12/724; H01R 2107/00

USPC ..... 439/607.27, 607.24, 607.41, 607.05

See application file for complete search history.

(56) References Cited

U.S. PATENT DOCUMENTS

| | | | | |
|---|---|---|---|---|
| 7,758,379 | B2 * | 7/2010 | Chen | H01R 13/6485 439/607.11 |
| 8,684,769 | B2 * | 4/2014 | Kao | H01R 13/6471 439/607.28 |
| 8,808,029 | B2 * | 8/2014 | Castillo | H01R 13/6585 439/607.05 |
| 8,968,031 | B2 * | 3/2015 | Simmel | H01R 13/659 439/108 |
| 2016/0020560 | A1 * | 1/2016 | Ju | H01R 24/78 439/607.05 |

* cited by examiner

*Primary Examiner* — Khiem Nguyen
(74) *Attorney, Agent, or Firm* — Bacon & Thomas, PLLC

(57) ABSTRACT

An electrical connector comprises a casing configured with a piecing gap and at least one solder adhering cavity. An imaging soldering line occurs in part of the piecing gap and in part of the solder adhering cavity. An insulative base includes a plurality of first terminals, a plurality of second terminals, an upper internal conductive sheet, and a lower internal conductive sheet. Thereafter, an improving electrical connector is provided.

12 Claims, 11 Drawing Sheets

ELECTRICAL CONNECTOR

CROSS-REFERENCE TO RELATED APPLICATIONS

This application claims the benefit of the filing date under 35 U.S.C. §119(a)-(d) of Taiwan Patent Application No. 104202176, filed Feb. 11, 2015.

BACKGROUND OF THE INVENTION

Field of the Invention

The present invention relates to an electrical connector.

Description of the Related Art

As technology advances, the sizes of electrical connectors are getting smaller and smaller, and the number of terminals increases with the upgrade of the transmission specifications. Take one of the new electrical connector specifications (USB C type connector) as an example: the overall size of a USB C type electrical connector is smaller than the USB 2.0 electrical connector, and the USB C type electrical connector has two rows of terminals, in which the number of terminals in each row is 12.

In other words, a USB C type connector includes a larger amount of terminals needed to be disposed in a smaller space (the insulative base) as compared with the USB 2.0 electrical connector. In consideration of holes provided as corresponding to the positions of the terminals in the insulative base of an electrical connector, therefore, if the number of terminals increases, the structural strength of the insulative base will reduce. Furthermore, since the terminals are narrowed in width, the structural strength of the terminals becomes weaker. When this kind of electrical connector is being assembled, the differences among the strengths exerted on the terminals by different operators may lead to a bend or a curve in the terminals and a false installation of the terminals on the insulative base. In addition, since the terminal width is very small and the number of terminals is quite large, the operators have difficulties determining with eyes whether the terminals are properly assembled. Therefore, such kind of electrical connector has higher defect rate.

SUMMARY OF THE INVENTION

The present invention provides an electrical connector with novel structure and preferred assembly yield.

The electrical connector of the present invention comprises: a casing, which is configured with a piecing gap and at least one solder adhering cavity wherein an imaging soldering line occurs in part of said piecing gap and/or in part of said solder adhering cavity. The insulative base is disposed within the casing and includes a top complex, and a bottom complex. The plurality of first terminals and the plurality of second terminals penetrate through the top complex and the bottom complex respectively. The upper internal conductive sheet is fixed to the insulative base and disposed at a side of the top complex in such a manner that a partial portion of the plurality of first terminals is sheltered by the upper internal conductive sheet. The lower internal conductive sheet is fixed to the insulative base and disposed at a side of the bottom complex in such a manner that a partial portion of some of the plurality of second terminals is sheltered by the lower internal conductive sheet.

According to one embodiment of the present invention, said insulative base including said top complex, a center complex, and said bottom complex in sequential connection.

According to one embodiment of the present invention, the electrical connector further comprises an external conductive sheet being configured in said center complex, isolating said plurality of first terminals and said plurality of second terminals.

According to one embodiment of the present invention, at least one vacant portion being preserved to said top complex, or said bottom complex, wherein said vacant portion is arranged with a predetermined position of said first terminals or said second terminal, and said external conductive sheet is configured with a hollow portion corresponding to said vacant portion.

According to one embodiment of the present invention, the insulative base includes at least one first engagement hole and at least one second engagement hole. The upper internal conductive sheet includes at least one first positioning protrude which is inserted into the first engagement hole. The lower internal conductive sheet includes at least one second positioning protrude which is inserted into the second engagement hole.

According to one embodiment of the present invention, the first engagement hole and the second engagement hole are disposed within the center complex.

According to one embodiment of the present invention, the center complex includes a tongue, whose two opposite surfaces have a plurality of ditches for accommodating a partial portion of some of the plurality of some of first terminals and a partial portion of the plurality of second terminals.

According to one embodiment of the present invention, the internal conductive sheet includes a first section and a second section connected to the first section. There is a turn between the first section and the second section. The first section covers a partial portion of the top complex, and the second portion covers a partial portion of some of the plurality of first terminals.

According to one embodiment of the present invention, the first section of the internal conductive sheet includes a plurality of arms, which slightly tilts toward the casing.

According to one embodiment of the present invention, the external conductive sheet includes an ECS body and a plurality of apertures penetrating the ECS body, wherein a partial portion of the center complex extends into the apertures.

According to one embodiment of the present invention, the external conductive sheet includes at least one conductive tail perpendicular to the ECS body. At least one conductive tail and a partial portion of the second terminals that is disposed at a position far away from an opening of the casing are arranged in the same column.

According to one embodiment of the present invention, a partial portion of the external conductive sheet is exposed to the leading edge and side edge of the center complex.

The present invention is further explained by the preferred embodiments and the appended drawings below.

DETAILED DESCRIPTION OF THE EMBODIMENT(S)

Figure 1:
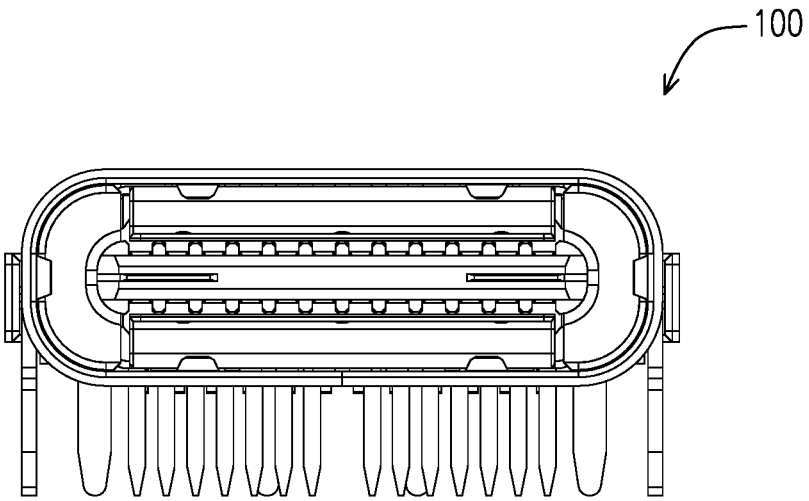
FIG. 1 is a schematic diagram of an electrical connector according to one embodiment of the present invention.
Figure 2:
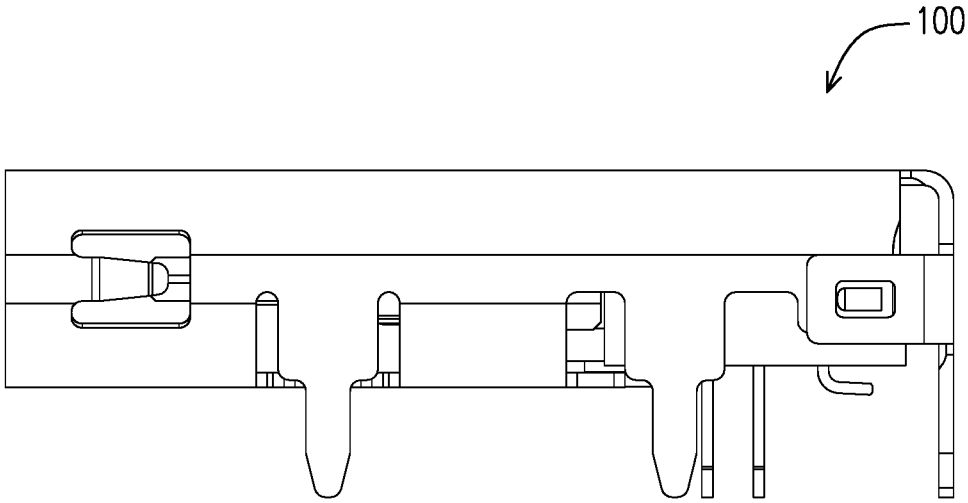
FIG. 2 to FIG. 4 are schematic diagrams of the electrical connector shown in FIG. 1 viewed from different angles.
Figure 3:
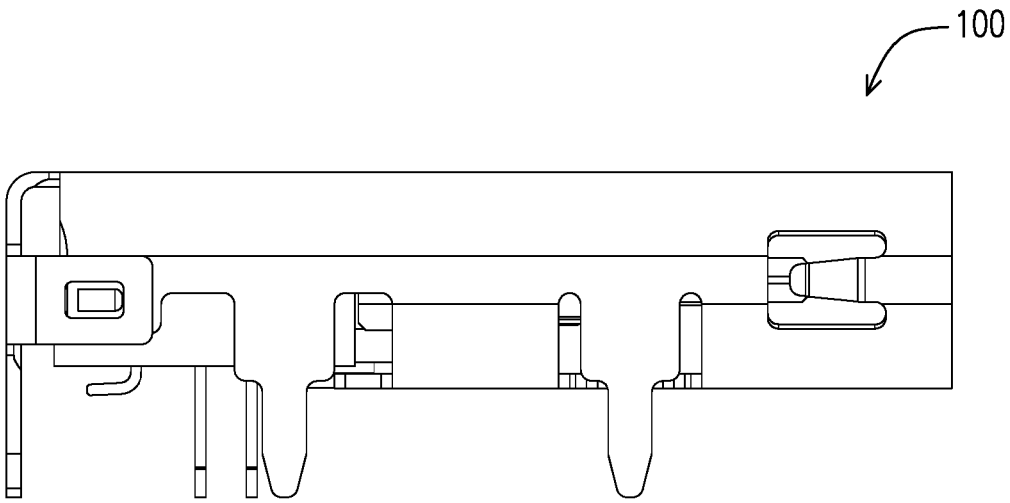
Figure 4:
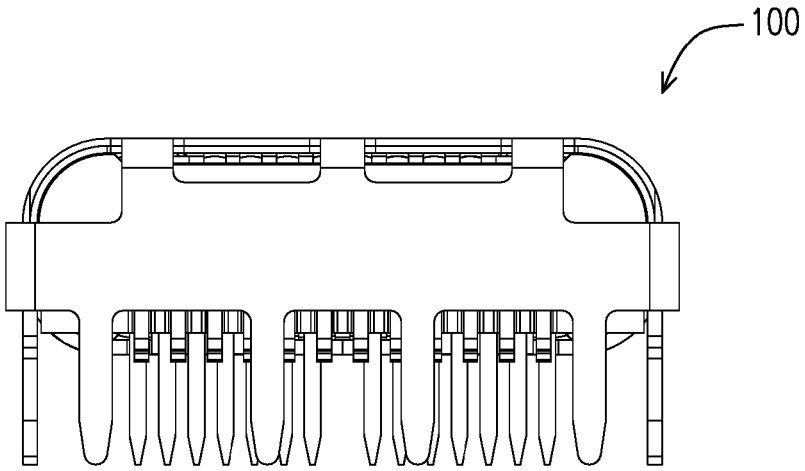

FIG. 1 is a schematic diagram of an electrical connector 100 according to one embodiment of the present invention. FIG. 2 to FIG. 4 are schematic diagrams of the electrical connector 100 shown in FIG. 1 viewed from different angles. More specifically, FIG. 1 is a front view of the electrical connector 100 according to this embodiment, and FIG. 2, FIG. 3 are respectively the left side view and the right side view of the electrical connector 100 according to this embodiment. FIG. 4 is a back side view of the electrical connector 100 according to this embodiment. In this embodiment, the electrical connector 100 is a female USB C type connector, but the present invention does not limit the type of the electrical connector 100.

Figure 5:
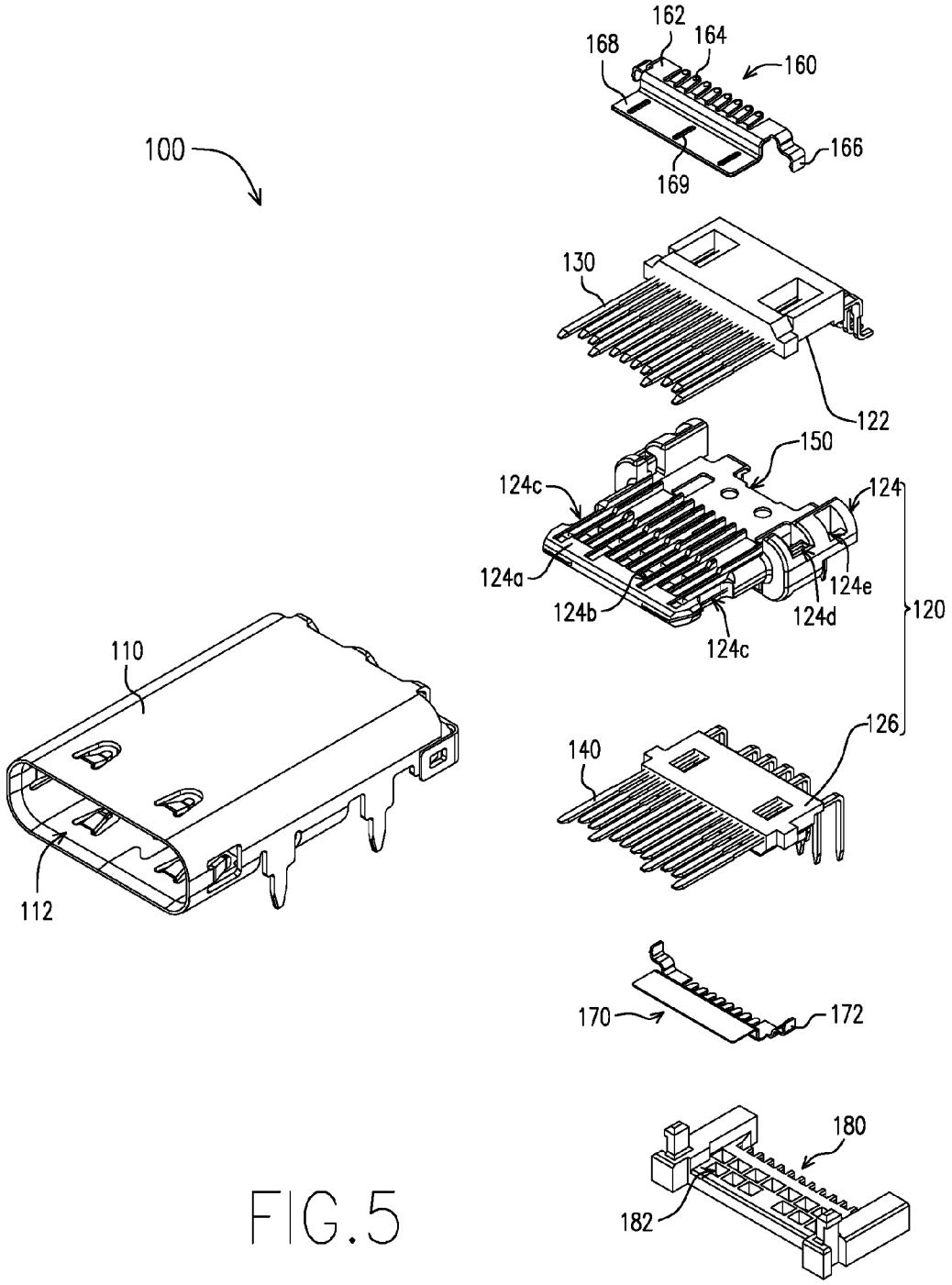
FIG. 5 is an exploded perspective view of the electrical connector shown in FIG. 1.
Figure 6:
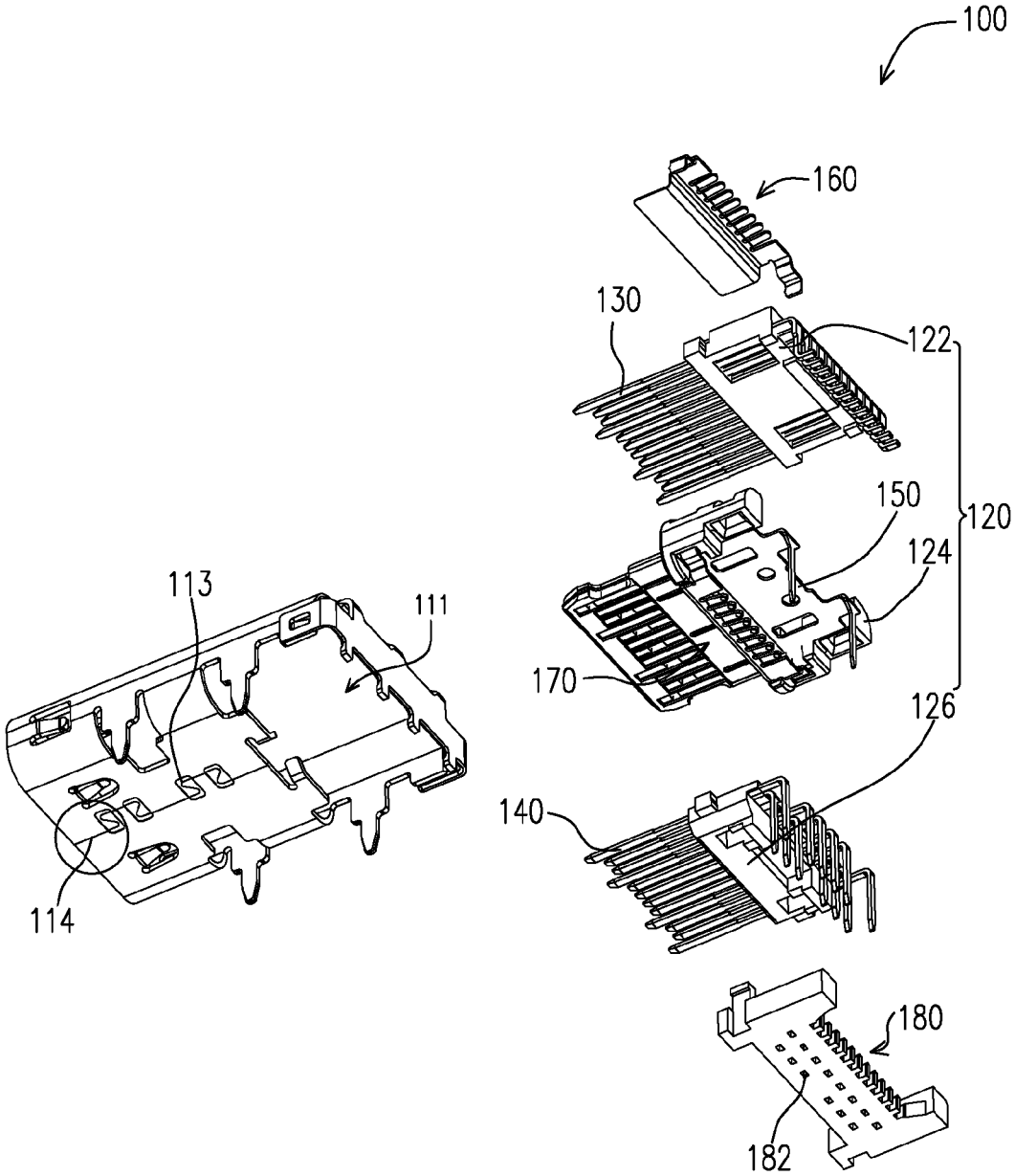
FIG. 6 is further exploded perspective view of the electrical connector shown in FIG. 5 viewed from different angles.

The detailed components of the electrical connector 100 according to this embodiment are shown in FIG. 5 and FIG. 6. FIG. 5 is an exploded perspective view of the electrical connector 100 shown in FIG. 1. FIG. 6 is a schematic diagram of the electrical connector 100 shown in FIG. 5 viewed from different angles. The electrical connector 100 of this embodiment comprises: a casing 110, an insulative base 120 disposed within the casing 110, a plurality of first terminals 130, a plurality of second terminals 140, an external conductive sheet 150, an upper internal conductive sheet 160, a lower internal conductive sheet 170, and a block 180.

Figure 7:
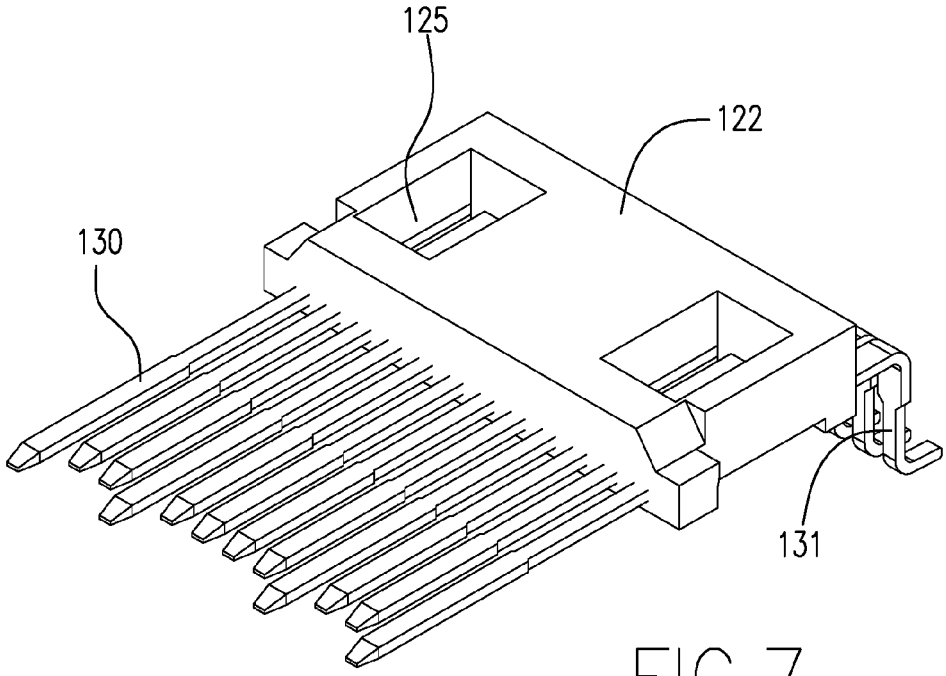
FIG. 7 is a schematic diagram of a top complex and a plurality of first terminals of the electrical connector shown in FIG. 1.
Figure 8:
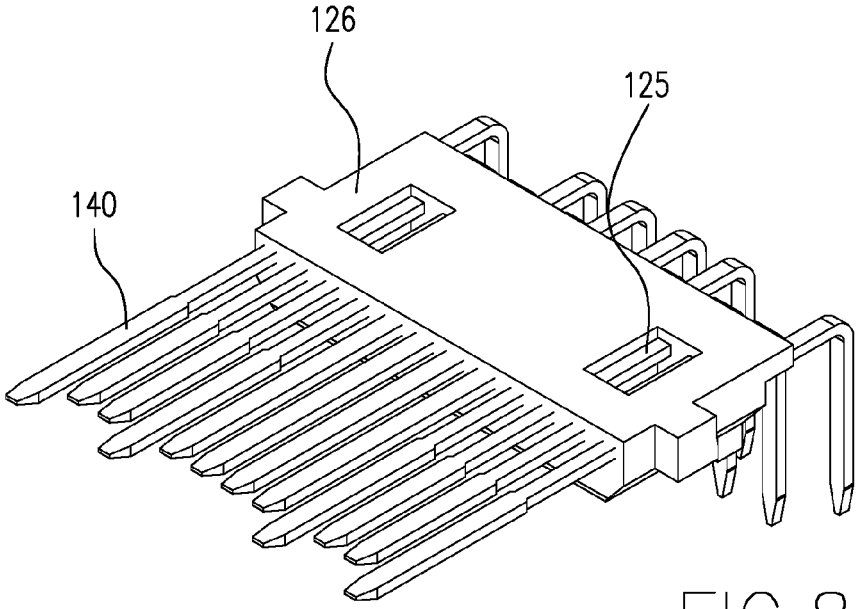
FIG. 8 is a schematic diagram of a bottom complex and a plurality of second terminals of the electrical connector shown in FIG. 1.
Figure 9:
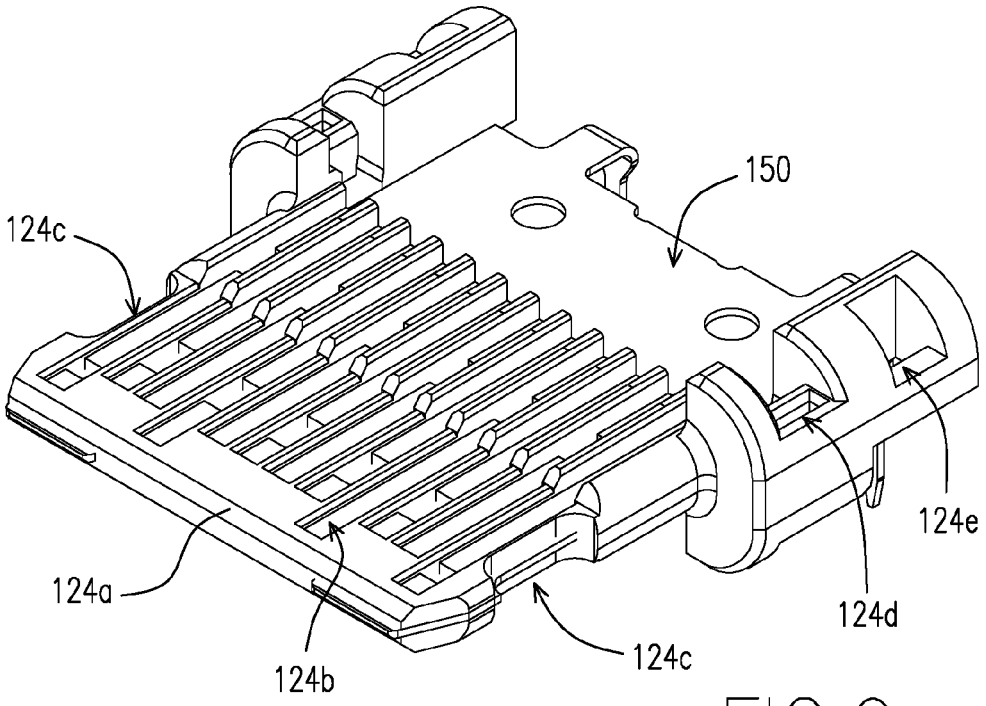
FIG. 9 is a schematic diagram of a center complex and a external conductive sheet of the electrical connector shown in FIG. 1.
Figure 10:
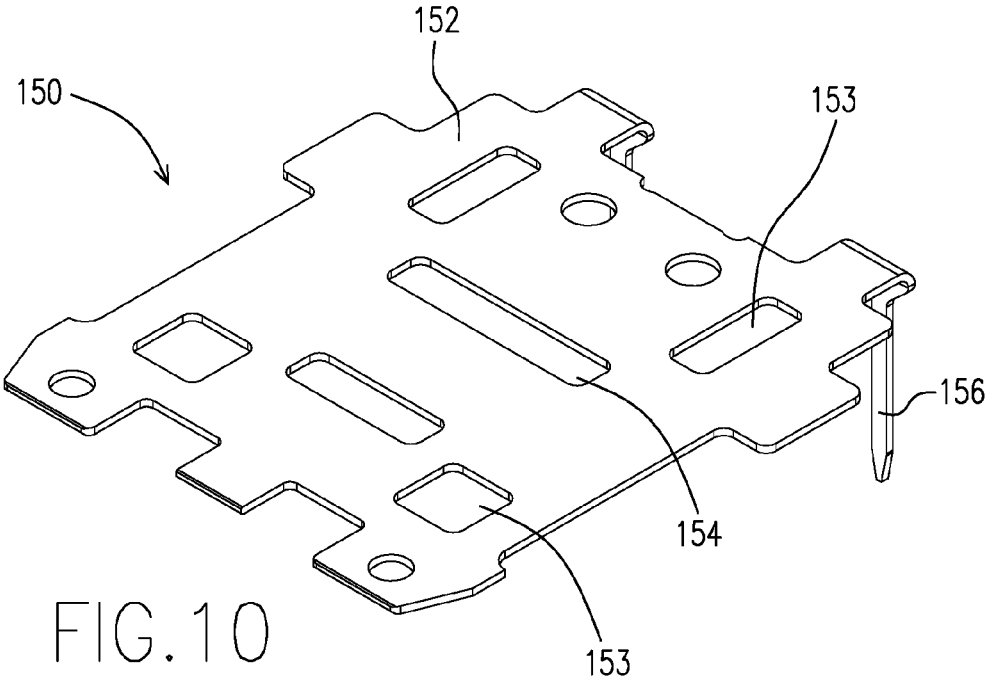
FIG. 10 is a schematic diagram of the external conductive sheet of the electrical connector shown in FIG. 1.
Figure 11:
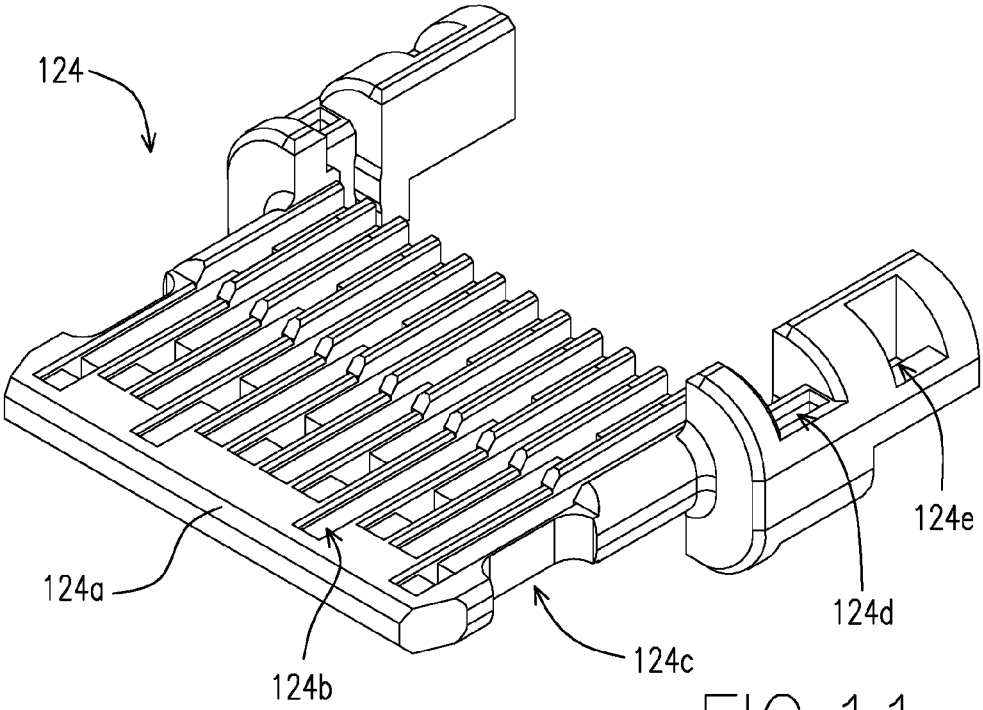
FIG. 11 is a schematic diagram of the center complex of the electrical connector shown in FIG. 1.

FIG. 7 is a schematic diagram illustrating a top complex 122 and a plurality of first terminals 130 of the electrical connector 100 shown in FIG. 1. FIG. 8 is a schematic diagram illustrating a bottom complex 126 and a plurality of second terminals 140 of the electrical connector 100 shown in FIG. 1. FIG. 10 is a schematic diagram illustrating the external conductive sheet 150 of the electrical connector 100 shown in FIG. 1. FIG. 11 is a schematic diagram illustrating a center complex 124 of the electrical connector 100 shown in FIG. 1. FIG. 9 is a schematic diagram illustrating a center complex 124 and the external conductive sheet 150 of the electrical connector 100 shown in FIG. 1. Please refer to FIG. 5 to 11, wherein the insulative base 120 includes the top complex 122, the center complex 124, and the bottom complex 126 in sequential connection. In this embodiment, the center complex 124 and the bottom complex 126 are made of insulating materials, such as resins or high-polymer. However, the materials of the center complex 124 and the bottom complex 126 are not limited to these as long as they possess insulating properties.

A partial portion of these plurality of first terminals 130 and a partial portion of these plurality of second terminals 140 penetrate through the top complex 122 and the bottom complex 126 respectively. More specifically, the middle portion of the first terminals 130 and the middle portion of the second terminals 140 penetrate through the top complex 122 and the bottom complex 126, and the opposite ends of the first terminals 130 and the opposite ends of the second terminals 140 are exposed outside the top complex 122 and the bottom complex 126. An end of the first terminals 130 and an end of the second terminals 140 that are disposed at a position near an opening 112 of the casing 110 are for connecting a corresponding electrical connector (not shown in the drawings). An end of the first terminals 130 and an end of second terminals 140 that are disposed at a position far away from the opening 112 of the casing 110 are for connecting with a circuit board (not shown in the drawings). The external conductive sheet 150 penetrates through the center complex 124 to isolate the first terminals 130 and the second terminals 140 so as to prevent the signal which is sent from the first terminals 130 and the signal which is sent from the second terminals 140 from interfering with each other.

In this embodiment, the assembly of the electrical connector begins with disposing the first terminals 130, the external conductive sheet 150, and the second terminals 140 within the top complex 122, the center complex 124, and the bottom complex 126 respectively via Insert-Molding process, followed by fixing relative positions among the top complex 122, the center complex 124, and the bottom complex 126. However, the method of assembling the first terminals 130, the external conductive sheet 150, the second terminals 140, the top complex 122, the center complex 124, and the bottom complex 126 is not limited to this. In other embodiments, the first terminals 130, the external conductive sheet 150, and the second terminals 140 can be fixed to the top complex 122, the center complex 124, and the bottom complex 126 by being inserted into the top complex 122, the center complex 124, and the bottom complex 126. Moreover, the relative positions among the top complex 122, the center complex 124, and the bottom complex 126 can be fixed by integrally-molded process or by other methods such as sticking the complexes together.

Figure 15:
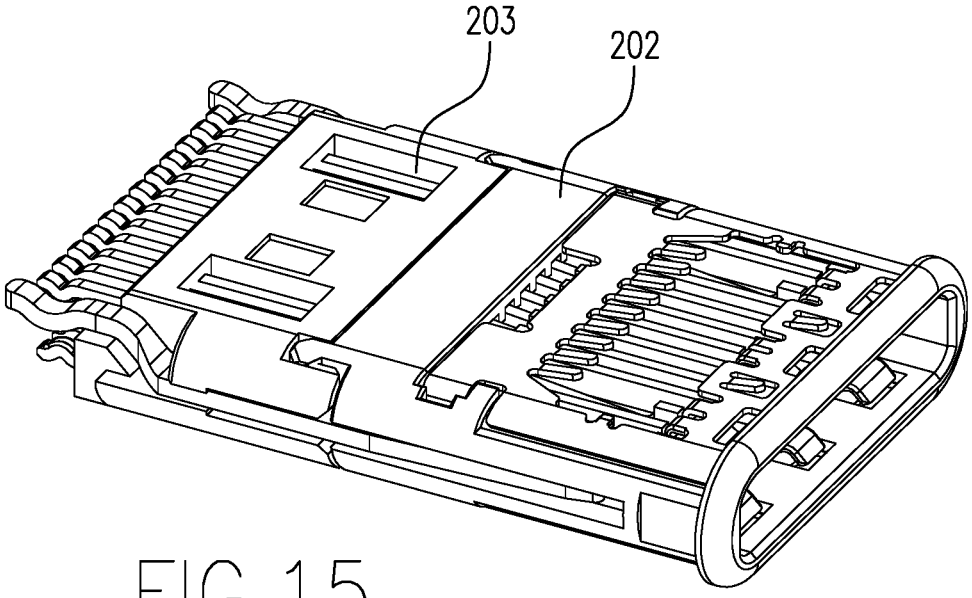
FIG. 15 is a perspective view of a corresponding electrical connector according to one embodiment of the present invention, without the casing.
Figure 16:
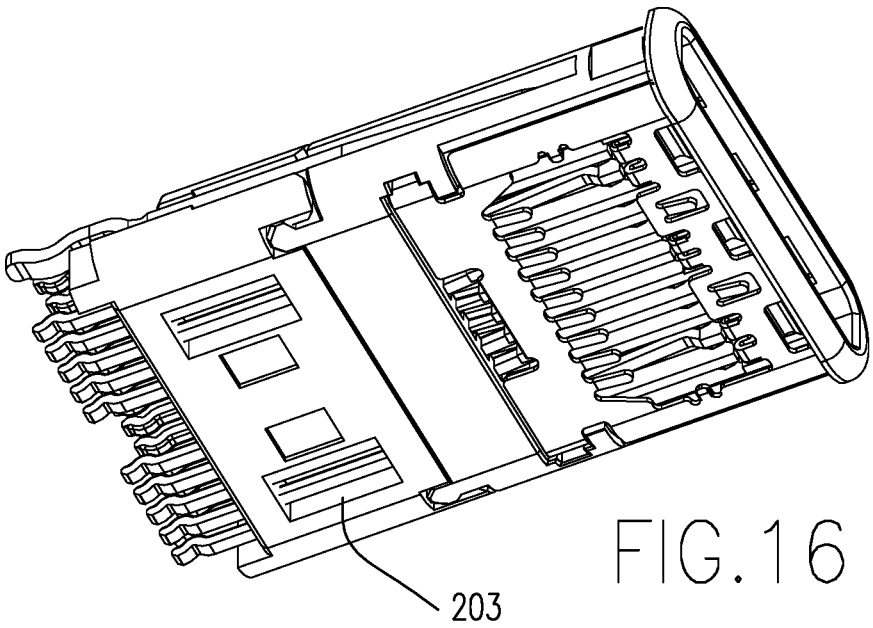
FIG. 16 is another perspective view shown in FIG. 15.
Figure 17:
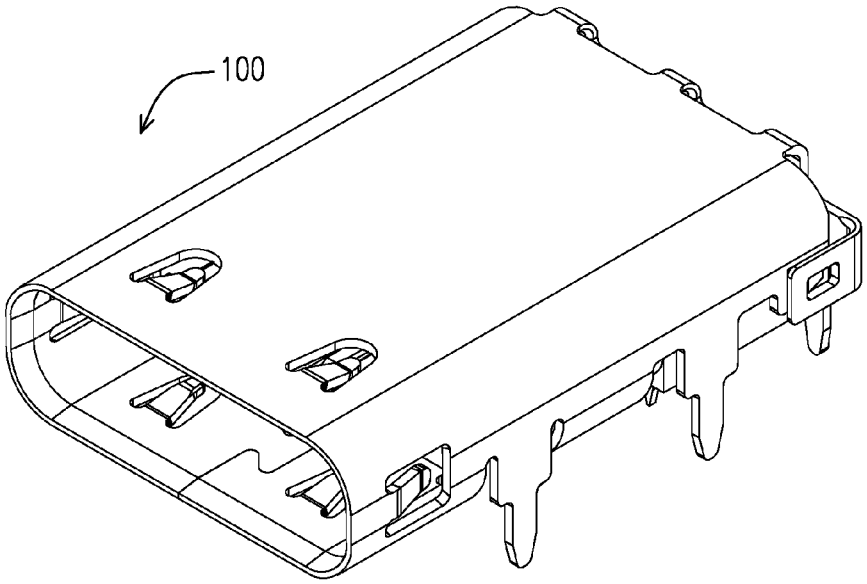
FIG. 17 is a perspective view of electrical connector according to one embodiment of the present invention.
Figure 18:
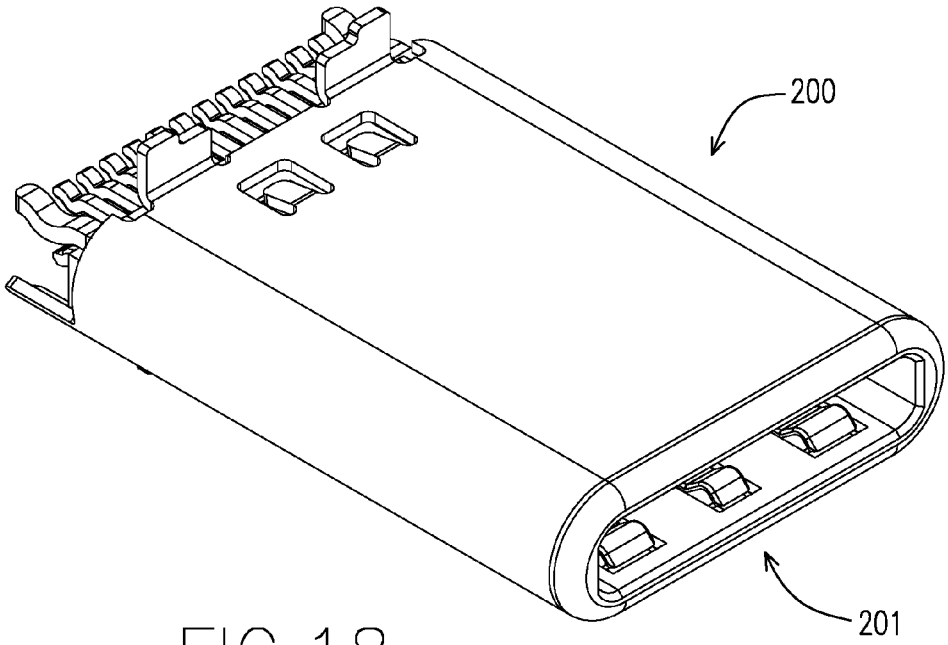
FIG. 18 is a perspective view of a corresponding electrical connector shown in FIG. 15.

At least one vacant portion 125 is preserved to the top complex 122, or the bottom complex 126. This preservation must took place with the first terminals 130, or the second terminal 140, preferably at the location where a pair of signal terminals arranged, so the electrical characteristic can be affected on purpose to improve impedance or else. In addition, the body 131 of the first terminals 130 (or the second terminal 140) shown in FIG. 7 is configured with a thinner tail for pursuing similar effect described above. Likewise, in FIG. 15, FIG. 16 and FIG. 18, a corresponding electrical connector 200 is configuring to have a insulative base 202 with vacant portions 203. The mating portion 201 of the corresponding electrical connector 200 is mating with the opening 112 of the electrical connector 100.

In this embodiment, the electrical connector 100 is a female USB C type connector. The number of the first terminals 130 and the number of the second terminals 140 are both 12. The center complex 124 includes a tongue 124*a*, whose two opposite surfaces have a plurality of ditches 124*b*. In this embodiment, each of the two opposite surfaces of the tongue 124*a* has twelve ditches 124*b*, and it is noted although FIG. 5, FIG. 6, FIG. 9, and FIG. 11 only show the upper surface of the tongue 124*a* having ditches 124*b* due to the limited viewing angle, the lower surface of the tongue 124*a* also has ditches 124*b*. A portion of the twelve first terminals 130 and a portion of the twelve second terminals 140 that are in a position near the opening 112 of the casing 110 are disposed to insert into the ditches 124*b* of the upper and lower surface of the tongue 124*a* to fix the relative position between the plurality of the first terminals 130 and the plurality of the second terminals 140.

Figure 19:
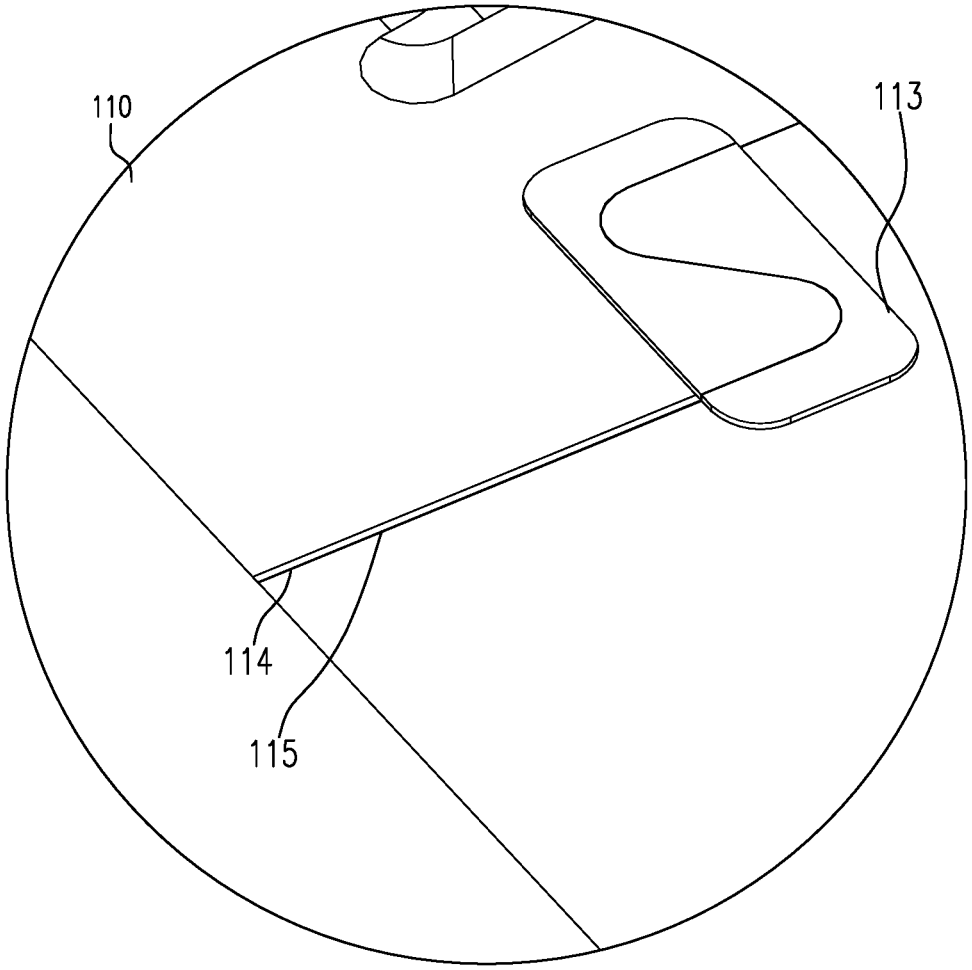
FIG. 19 illustrates the detail of the electrical connector shown in FIG. 6.

Seen from the viewing angle of FIG. 6, the partial portions of the twelve first terminals 130 that are disposed at a position far away from the opening 112 of the casing 110 are arranged in the same row, and the partial portions of the twelve second terminals 140 that are disposed at a position far away from the opening 112 of the casing 110 are arranged in two rows, in which each row has six second terminals 140. Certainly, in other embodiments, the number of the first terminals 130, the number of the second terminals 140, and the arrangement method of the partial portions of the first terminals 130 and the second terminals 140 that are disposed at a position far away from the opening 112 of the casing 110 are not limited to the above-mentioned description. In other embodiments of different kinds of electrical connector 100 (not shown in the drawings), the electrical connectors 100 can be arranged with only the first terminals 130, in which the partial portions of the first terminals 130 that are disposed at a position far away from the opening 112 of the casing 110 are disposed in different rows. Alternatively, the electrical connectors 100 can include both the first terminals 130 and the second terminals, wherein the partial portions of the second terminals 140 that are disposed at a position far away from the opening 112 of the casing 110 can be arranged in the same row. The casing 110 is configured with a receiving space 111 to accommodate the insulative base 120. A piecing gap 114 is happened while forming the casing, wherein in one section of the piecing gap 114, at least one solder adhering cavity 113 is configuring to allow the solder material adhering while the electrical connector 100 was conducting in the reflow process. One of the purposes is to make the connector 100 firmly fix on the print circuit board with the solder adhering cavity 113. Furthermore, when the solder material flowed along with the piecing gap 114, an imaging soldering line 115 occurs (shown in FIG. 19) that is able to block leaking of electrical capacity, so it reduces loss of electrical signals as high frequency data requiring higher stability of signal processing. Additionally, the soldering line 115 is a physical line along with the piecing gap 114 or the solder adhering cavity 113 when the solder material has cooled itself down under the melting point.

Besides, in this embodiment, the external conductive sheet 150 includes an ECS body 152 and a plurality of apertures 154 penetrating the ECS body 152 so as to stably insert and fix the external conductive sheet 150 into the center complex 124, as shown in FIG. 10. In the insert-molding process, a partial portion of the center complex 124 reaches into the apertures 154 to increase the adhesion between the apertures 154 and the center complex 124. Corresponding to above-mentioned vacant portion 125, the external conductive sheet 150 is configured with a hollow portion 153 as well.

Furthermore, the external conductive sheet 150 includes at least one conductive tail 156 perpendicular to the ECS body 152. In this embodiment, the external conductive sheet 150 includes two conductive tails 156. As can be seen in FIG. 6 and FIG. 8, the partial portions of the second terminals 140 that are disposed at a position far away from an opening 112 of the casing 110 are arranged in two rows. The row near the outside has six second terminals 140, in which the distance between the any one of the outermost second terminals 140 and it neighboring second terminals 140 is twice longer than the distance between the middle two second terminals 140. In this row, the space between any one of the outermost second terminals 140 and its neighboring second outermost second terminals 140 is for accommodating the two conductive tails 156 of the external conductive sheet 150 in such a manner that the two conductive tails and the six second terminals are in the same row. Obviously, in other embodiment, the conductive tails 156 and the six second terminals 140 can be arranged in different rows.

Besides, as can be seen in FIG. 9, a partial portion of the external conductive sheet 150 is exposed at the leading edge and side edge of the center complex 124. In detail, each outer side of the center complex 124 has a recession 124*c*, in which a partial portion of the external conductive sheet 150 is exposed at the recession 124*c*. Moreover, partial portions of the external conductive sheet 150 are exposed at the two outer sides of the leading edge of the center complex 124. When the electrical connector 100 of this embodiment connects with a corresponding electrical connector, the two partial portions of the external conductive sheet 150 that are exposed at the two recessions 124*c* of the two outer edge of the center complex 124 and the two partial portions of the external conductive sheet 150 that are exposed at the two sides of the leading edge of the center complex 124 can electrically connect with the corresponding electrical connector. In this embodiment, the external conductive sheet 150 is not exposed outside the whole leading edge of the center complex 124 so as to maintain the structural strength of the center complex 124. However, in other embodiments, if other ways exist for increasing the structural strength of the center complex 124, the external conductive sheet 150 can be exposed outside the leading edge of the center complex 124. Certainly, the partial portion of the center complex 124 at which the external conductive sheet 150 is exposed is not limited to this.

Please refer back to FIG. 5 and FIG. 6. The block 180 includes a plurality of notches 182 to fix the relative positions among the partial portions of the second terminals 140 that are disposed at a position far away from the opening 112 of the casing 110. Since the portions of the second terminals 140 disposed at a position far away from the opening 112 of the casing 110 are arranged in two rows, the plurality of notches 182 of the block 180 corresponding to the two rows of the second terminals 140 are arranged in two rows in such manner that the second terminals 140 penetrate through a place far away from the opening 112 of the casing 110. Certainly, in other embodiments, the number of rows of the notches 182 can vary according to the arrangement method of the second terminals 140, or the arrangement method of the first terminals 130.

Figure 12:
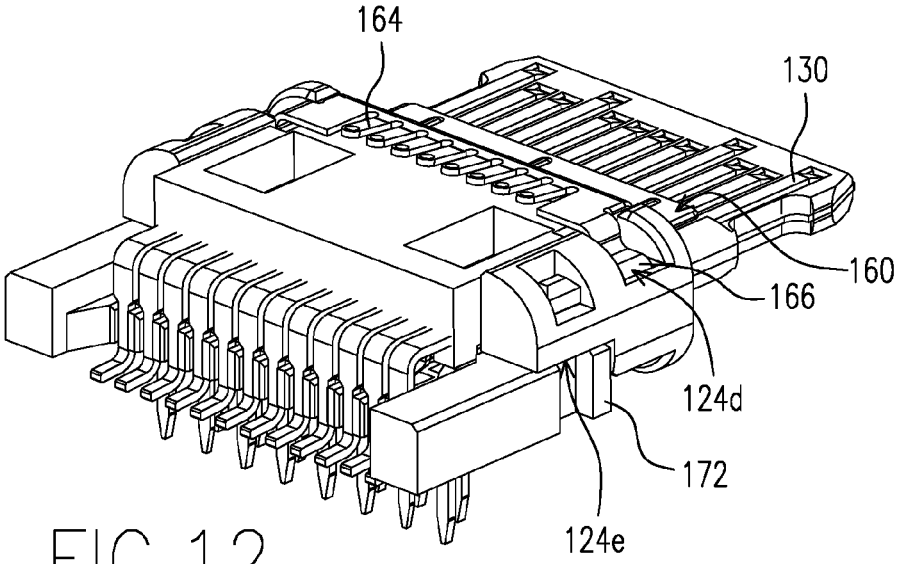
FIG. 12 is a three dimensional view of the electrical connector without the casing.
Figure 13:
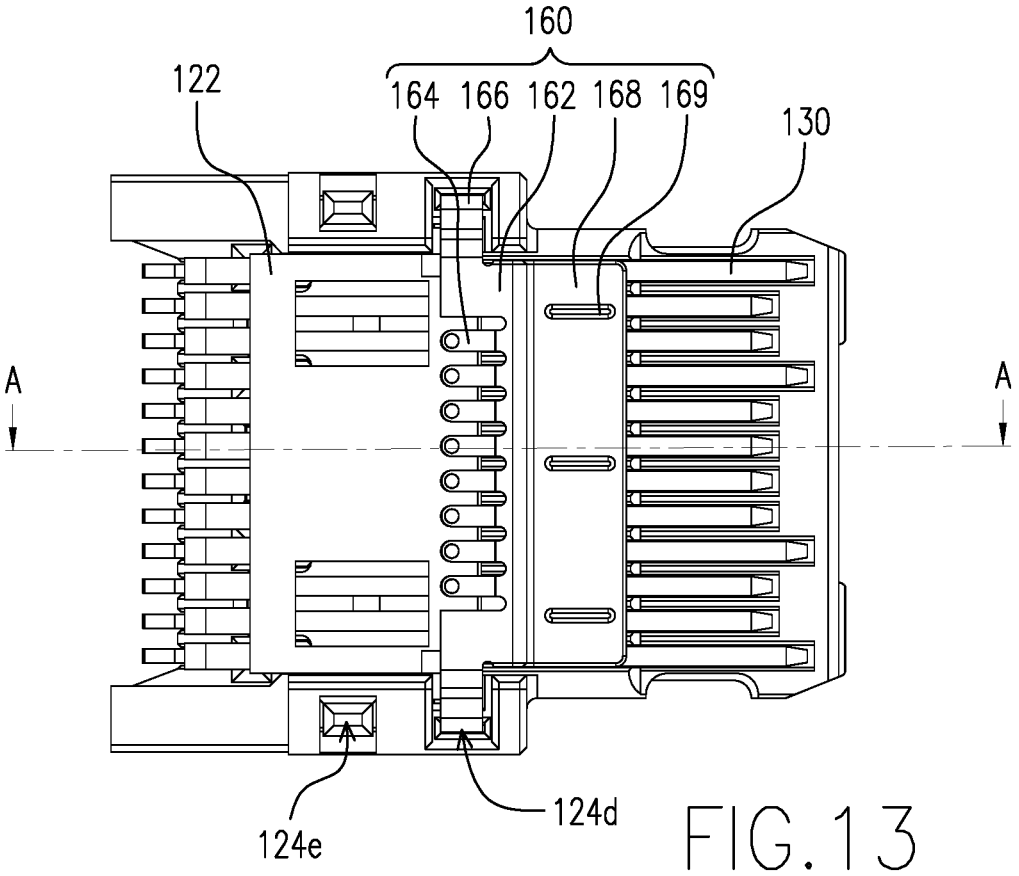
FIG. 13 is a schematic diagram of the electrical connector shown in FIG. 12 viewed from another angle.
Figure 14:
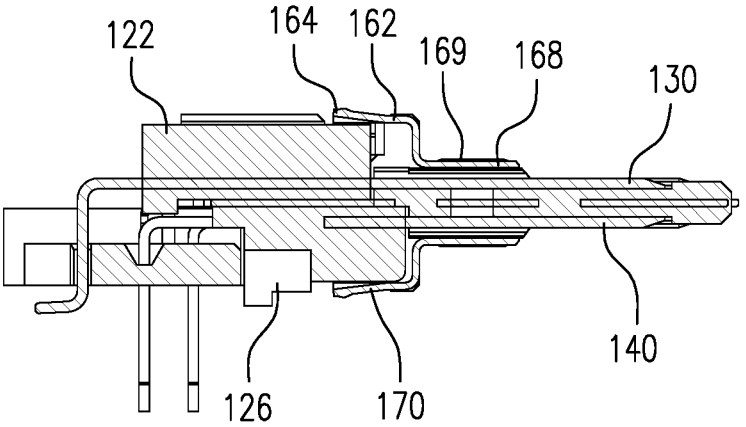
FIG. 14 is a sectional schematic view along line A-A shown in FIG. 13.

FIG. 12 is a three dimensional view of the electrical connector 100 of FIG. 1 without the casing 110. FIG. 13 is a schematic diagram of the electrical connector 100 shown in FIG. 12 viewed from another angle. FIG. 14 is a sectional schematic view along line A-A shown in FIG. 13. FIG. 12 to FIG. 14 are schematic diagrams of assembling the elements of the electrical connector 100 of this embodiment without the casing 110. Please refer to FIG. 5, FIG. 12 to FIG. 14 at the same time. The upper internal conductive sheet 160 is disposed at a side of the top complex 120, sheltering a partial portion of some of the plurality of first terminals 130. The lower internal conductive sheet 170 is disposed at a side of the bottom complex 126, sheltering a partial portion of some of the plurality of second terminals 140. In addition to the casing 110 made of metal material that provides anti-electromagnetic effect, the electrical connector 100 of this embodiment achieves anti-electromagnetic interference effect also through the setting of the upper internal conductive sheet 160 and the lower internal conductive sheet 170 so as to enhance the anti-electromagnetic interference effect.

The upper internal conductive sheet 160 and the lower internal conductive sheet 170 are fixed to the insulative base 120 by assembly methods. In detail, the center complex 124 of the insulative base 120 includes at least one first engagement hole 124*d* and at least one second engagement hole 124*e*. The upper internal conductive sheet 160 and the lower internal conductive sheet 170 respectively include at least one first positioning protrude 166 and at least one second positioning protrude 172. The first positioning protrude 166 and the second positioning protrude 172 are inserted into the first engagement hole 124*d* and the second engagement hole 124*e* respectively in such a manner that the upper internal conductive sheet 160 and the lower internal conductive sheet 170 are fixed to the insulative base 120. Certainly, in other embodiments, the first engagement hole 124*d* and the second engagement hole 124*e* can be disposed at in the top complex 122 or the bottom complex 126.

In addition, as shown in FIG. 5, FIG. 13 and FIG. 14, the internal conductive sheet 160 includes a first section 162 and a second section 168 connected to the first section 162. There exists a turn between the first section 162 and the second section 168. The first section 162 covers a partial portion of the top complex 122, and the second portion 168 covers a partial portion of the plurality of first terminals 130. The first section 162 of the internal conductive sheet 160 includes a plurality of arms 164, which slightly tilts toward the casing 110 (shown in the top of FIG. 14). When the casing 110 is mounted onto the above-mentioned components, the plurality of arms 164 of the internal conductive sheet 160 are electrically connected with the casing 110. The second section 168 of the internal conductive sheet 160 includes a plurality of resistant contacts 169. When a corresponding electrical connector connects with the electrical connector 100 of this embodiment, the corresponding electrical connector contacts the resistant contacts 169 to increase the resistance between the electrical connector and the corresponding electrical connector.

In this embodiment, it is noted that the lower internal conductive sheet 170 includes a plurality of arms and a plurality of resistant contacts as well, which is not shown in the schematic diagrams due to the viewing angle. The shape and function of the arms and the resistant contacts of the lower internal conductive sheet 170 are similar to that of the arms 164 and the resistant contacts 164 of the internal conductive sheet 160, and therefore the details about the arms and the resistant contacts of the lower internal conductive sheet 170 will not be presented here.

In summary, the electrical connector 100 of the present invention provides the external conductive sheet 150 between the first terminals 130 and the second terminals 140 to prevent the signal which is sent from the first terminals 130 and the signal which is sent from the second terminals 140 from being interfered with one another. The top complex 122 and the bottom complex 126 are disposed with the upper internal conductive sheet 160 and the lower internal conductive sheet 170 respectively, and disposes the casing 110 to cover the above-mentioned components to provide the electrical connector 100 with better anti-electromagnetic interference effect. Besides, the assembly of the electrical connector 100 of the present invention begins with inserting the first terminals 130, the external conductive sheet 150, and the second terminals 140 into the top complex 122, the center complex 124, and the bottom complex 126 respectively via a production method such as Insert-Molding process, and thereafter performs a step of assembling the top complex 122, the center complex 124, and the bottom complex 126 together. Next, the conductive tail 156 and the partial portion of the second terminals 140 that is positioned far away from the opening 112 of the casing 110 are covered with the block 180, and finally the first positioning protrude 166 of the upper internal conductive sheet 160 and the second positioning protrude 172 of the lower internal conductive sheet 170 are inserted into the first engagement hole 124*d* and the second engagement hole 124*e* of the center complex 124 in such a manner that after the upper internal conductive sheet 160 and the lower internal conductive sheet 170 are disposed at a side of the top complex 122 and the center complex 124, the upper internal conductive sheet 160 and the lower internal conductive sheet 170 together with the top complex 122 and the center complex 124 are inserted into the casing 110. The configuration structure of the present invention and the above-mentioned assembly methods can effectively enhance the overall assembly yield.

While the invention has been described in terms of various specific embodiments, those skilled in the art will recognize that the invention can be practiced with modification within the spirit and scope of the claims.

What is claimed is:

1. An electrical connector, comprising:

a casing, which is configured with a piecing gap and at least one solder adhering cavity wherein an imaging soldering line occurs in part of said piecing gap and/or in part of said solder adhering cavity;

an insulative base disposed within said casing, including a top complex, and a bottom complex;

a plurality of first terminals configuring in said top complex;

a plurality of second terminals configuring in said top complex;

an upper internal conductive sheet fixed to said insulative base and disposed at a side of said top complex, sheltering a part of said plurality of first terminals; and a lower internal conductive sheet fixed to said insulative base and disposed at a side of said bottom complex sheltering a part of said plurality of second terminals.

2. The electrical connector of claim 1, wherein said insulative base including said top complex, a center complex, and said bottom complex in sequential connection.

3. The electrical connector of claim 2, further comprising:

an external conductive sheet being configured in said center complex, isolating said plurality of first terminals and said plurality of second terminals.

4. The electrical connector of claim 3, at least one vacant portion (125) being preserved to said top complex, or said bottom complex, wherein said vacant portion is arranged with a predetermined position of said first terminals or said second terminal, and said external conductive sheet is configured with a hollow portion corresponding to said vacant portion.

5. The electrical connector of claim 2, wherein said insulative base includes at least one first engagement hole and at least one second engagement hole, wherein said upper internal conductive sheet includes at least one first positioning protrude which is inserted into said first engagement hole; said lower internal conductive sheet includes at least one second positioning protrude which is inserted into said second engagement hole.

6. The electrical connector of claim 5, wherein said first engagement hole and said second engagement hole are disposed within said center complex.

7. The electrical connector of claim 3, wherein said center complex includes a tongue, whose two opposite surfaces have a plurality of ditches for accommodating a part of said first terminals and a part of said plurality of second terminals.

8. The electrical connector of claim 1, wherein said internal conductive sheet includes a first section and a second section connected to said first section, wherein a turn is between said first section and said second section, and said first section covers a partial portion of the top complex, said second section covers a part of said plurality of first terminals.

9. The electrical connector of claim 8, wherein said first section of the internal conductive sheet includes a plurality of arms, which slightly tilts toward said casing.

10. The electrical connector of claim 3, wherein said external conductive sheet includes an external conductive sheet body (hereafter, "ECS body") and a plurality of apertures penetrating said ECS body, wherein a part of said center complex extends into said apertures.

11. The electrical connector of claim 10, wherein said external conductive sheet includes at least one conductive tail perpendicular to said ECS body; at least one conductive tail and a part of said second terminals disposed at a position far away from an opening of said casing are arranged in the same column.

12. The electrical connector of claim 3, wherein a part of said external conductive sheet is exposed to the leading edge and side edge of said center complex.

* * * * *